US005988792A

United States Patent [19]

Okazaki et al.

[11] Patent Number: 5,988,792

[45] **Date of Patent: *Nov. 23, 1999**

[54] INK JET APPARATUS AND CARTRIDGE HAVING A STRUCTURE FOR RUBBING A CLEANING BLADE

[75] Inventors: Takeshi Okazaki, Sagamihara; Kazuaki Masuda, Kawasaki; Tsutomu Abe, Isehara; Toshio Kashino, Chigasaki; Jun Kawai, Yokohama; Hiroki Tajima, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/666,917

[22] Filed: Jun. 19, 1996

Related U.S. Application Data

[63] Continuation of application No. 08/165,851, Dec. 14, 1993, abandoned.

[30] Foreign Application Priority Data

Dec. 18, 1992 [JP] Japan ..... 4-355774

[51] Int. Cl.[6] ..... B41J 2/135; B41J 2/165

[52] U.S. Cl. ..... 347/44; 347/33

[58] Field of Search ..... 347/22, 33, 36, 347/44, 63, 65, 67

[56] References Cited

U.S. PATENT DOCUMENTS

| | | | |
|---|---|---|---|
| 5,182,582 | 1/1993 | Okamura | 347/33 |
| 5,202,702 | 4/1993 | Terasawa et al. | 347/331 X |
| 5,266,974 | 11/1993 | Koitabashi et al. | 347/33 |

FOREIGN PATENT DOCUMENTS

| | | | |
|---|---|---|---|
| 04 94 693 | 7/1992 | European Pat. Off. | 347/33 |
| 0498579 | 8/1992 | European Pat. Off. . | |
| 3736916 | 5/1988 | Germany | B41J 3/04 |
| 4000454 | 7/1991 | Germany . | |
| 59-045162 | 3/1984 | Japan . | |
| 60-139454 | 7/1985 | Japan | 347/44 |
| 61-230949 | 10/1986 | Japan . | |
| 62-103147 | 5/1987 | Japan . | |
| 1-18642 | 1/1989 | Japan | 347/44 |
| 1-190459 | 7/1989 | Japan | 347/65 |
| 4-19150 | 1/1992 | Japan | 347/36 |
| 4-37556 | 2/1992 | Japan | 347/33 |

OTHER PUBLICATIONS

Drake, "Roofshooter Face Wiping Grooves," *Xerox Disclosure Journal*, vol. 14, No. 3, May/Jun. 1989.

*Primary Examiner*—N. Le
*Assistant Examiner*—Craig A. Hallacher
*Attorney, Agent, or Firm*—Fitzpatrick, Cella, Harper & Scinto

[57] ABSTRACT

An ink ejection recovery device including a cleaning blade for removing the ink adhered to the ejection orifice surface of a recording head further includes an ink removing mechanism, against which the cleaning blade is rubbed for removing the ink adhered to the cleaning blade itself, after wiping clean the ejection orifice surface; wherein the ink removing mechanism includes an ink transferring portion provided with a groove or a through hole, against which the cleaning blade is rubbed, and an ink absorbing member disposed in contact with the ink transferring portion.

11 Claims, 4 Drawing Sheets

INK JET APPARATUS AND CARTRIDGE HAVING A STRUCTURE FOR RUBBING A CLEANING BLADE

This application is a continuation of application Ser. No. 08/165,851 filed Dec. 14, 1993 now abandoned.

FIELD OF THE INVENTION AND RELATED ART

The present invention relates to an improved structure for a recovering means incorporated in the ink jet technology, an ink jet cartridge comprising a portion of the recovering means, and an ink jet apparatus comprising the cartridge.

Recently, the ink jet apparatus which effects recording of a desired image or the like on a recording medium, by ejecting liquid (ink) from ejection orifices, has come to be used in various fields of recording.

The structure of the liquid ejecting means (recording means) employed in such an ink jet apparatus is such that the ink is ejected by driving a piezo-electric element, electro-thermal transducer element, or the like. As the ink is ejected, most of it adheres to the recording medium, forming the desired picture image or the like, but a small portion of the ink becomes mist as it lands on the recording medium and splashes back, or satellite ink at the moment it is ejected. This ink mist or satellite ink adheres to the ejection orifice surface, thereby wetting the ejection orifice surface.

Further, the recording means discharges the ink out of the ejection orifices into a cap after a predetermined sequence of recording operation, or after a predetermined length of non-operating time. In other words, it carries out a recovery operation. As this recovery operation is performed, the ejection orifice surface is wetted by the discharged ink.

When the ejection orifice surface gets wet with the ink as described in the foregoing, the ink droplets ejected from the ejection orifices to effect recording are united with the ink adhering to the ejection orifice surface, deviating thereby from the direction in which the ink is initially ejected; therefore, the ink cannot land on the desired spots. As a result, recording quality is deteriorated.

Generally speaking, in order to improve this condition, a wiping blade made of elastic material is used to wipe clean the ejection orifice surface of the recording means after the recovery operation, or the completion of an intended recording operation. As the wiping blade wipes the ejection orifice surface, it removes both the ink sticking to the ejection orifice surface and also the foreign matter such as paper dust also sticking to the ejection orifice surface; therefore, superb recording can be continued.

Now, when the cleaning blade is left unattended after it wipes the ink on the ejection orifice surface, the ink or the like, now being on the cleaning blade, increases its viscosity. When this cleaning blade carrying the ink with increased viscosity is used to clean the ejection orifice surface, the ink with the increased viscosity is liable to re-adhere to the ejection orifice surface.

In other words, the foreign matter (common dust, or paper dust), or the ink with the increased viscosity (ink from which volatile ingredients have evaporated), adhering to the adjacent areas of the ejection orifices or the wiping surface of the wiping blade, enters the ejection orifices, or re-adheres to the areas adjacent to the orifices, during the wiping operations. Thus, the adhering foreign matter or the ink with the increased viscosity is liable to increase recording deviation, or ejection failure.

Further, there is another inconvenience. That is, the ink is drawn out of the ejection orifices during the wiping operation. More specifically speaking, as the elastic blade or the like blade wipes the ejection orifice surface during the wiping operation, the blade comes in contact with the ink in the ejection orifices, drawing out the ink, even though meniscuses are formed in the ejection orifices by the surface tension of the ink; therefore, the recording deviation or ejection failure is liable to occur. Further, the drawn out ink may cause wiping failure as it sticks to the ejection orifice surface and solidifies, which is another inconvenience.

There is another problem such that when two or more recording heads are consecutively wiped, the inks get mixed. For example, let it be assumed that a recording apparatus comprises two or more recording heads corresponding to the number of inks of different color, and these recording heads are wiped one after another. Then, when the wiping operation is carried out after an ink sucking operation or recording operation, the ink (wetting ink) adhering to the areas adjacent to the ejection orifices of the recording head located on the upstream side in the wiping direction is transferred onto the blade, and then, as the next recording head on the downstream side is wiped, the ink of different color, or the ink composed of different ingredients, is liable to invade the ejection orifices. When such invasion by the ink of a different color or composition occurs, it may result in a problem such as color mixing caused by the invasion of the ink of different color, or ejection failure caused by the invasion of the ink of different composition.

Therefore, a technology, such as the one disclosed in Japanese Laid-Open Patent No. 45162/1984, for cleaning the cleaning blade was proposed, in which the cleaning blade, to which the ink or the foreign matter adhered after the ejection orifice surface was cleaned by the cleaning blade, was rubbed by an absorbing member, whereby the ink or the foreign matter was transferred to the absorbing member.

More specifically, if an ink jet apparatus is provided with an exchangeable structure in which a recording head as the recording means and an ink container for storing the ink to be supplied to the recording head are integrated, and in addition, the exchangeable structure is provided with the absorbing member for cleaning the cleaning blade, the absorbing member never fails to be semi-periodically exchanged, that is, each time the ink contained in the ink container is depleted; therefore, the efficiency with which the cleaning blade is cleaned does not deteriorate to an extreme degree, being maintained at a substantially constant level.

However, when the absorbing member for cleaning the cleaning blade is fresh, the ink absorbed by the absorbing member migrates from the contact area where the absorbing member comes in contact with the cleaning blade, to the other portions of the absorbing member, due to the capillary force, but after the cleaning operation is performed a given number of times, the absorbed ink or the transferred foreign matter is liable to remain at the contact area of the absorbing member, creating a state in which the cleaning blade cannot be satisfactorily cleaned. Further, the ink remaining at the contact area of the absorbing member gradually increases its viscosity, and eventually, the ink with the increased viscosity is liable to be transferred back to the cleaning blade.

When such a situation exists, it cannot be assured that the cleaning blade can be properly cleaned.

SUMMARY OF THE INVENTION

Accordingly, a primary object of the present invention is to improve the previously described structure for cleaning the cleaning blade, providing thereby a recovery means with a more reliable, innovative, and improved structure for cleaning the cleaning blade.

According to an aspect of the present invention, a recovery means comprising a cleaning blade for removing the ink adhering to the ejection orifice surface of a recording head further comprises: an ink removing mechanism, against which the cleaning blade is rubbed for removing the ink adhering to the cleaning blade itself, after wiping clean the ejection orifice surface; wherein the ink removing mechanism further comprises an ink transferring portion provided with a number of grooves or through holes, against which the cleaning blade is rubbed, and an ink absorbing member positioned in contact with the ink transferring portion.

According to another aspect of the present invention, an ink jet cartridge comprises: ejection orifices for ejecting ink; an ejection orifice surface on which the ejection orifices are located; and an ink removing mechanism located on the extension of the ejection orifice surface; wherein the ink removing mechanism comprises an ink transferring portion provided with a number of grooves or through holes, against which the cleaning blade is rubbed, and an ink absorbing member positioned in contact with the ink transferring portion.

According to another aspect of the present invention, an ink jet apparatus comprises: conveying means for conveying recording medium; a recovery mechanism for recovering the ink ejection performance of an ink jet cartridge comprising a recording head which ejects ink; a carriage which carries the ink jet cartridge, and scans a recording zone where the recording medium is conveyed, and a non-recording zone where the recovery mechanism is located; wherein the ink removing mechanism is located on a part of the carriage, and the ink removing mechanism comprises an ink transferring portion provided with a number of grooves or through holes, against which the cleaning blade for cleaning ejection orifices surface, on which ejection orifices of an ink jet cartridge comprising the recovery mechanism are located, is rubbed, and an ink absorbing member positioned in contact with the ink transferring portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
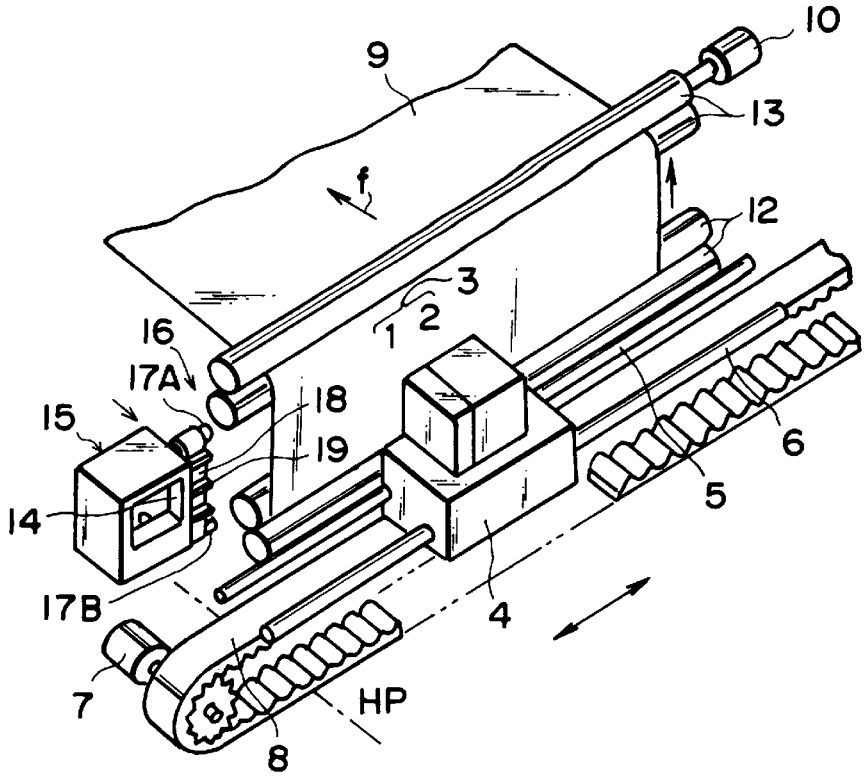
FIG. 1 is an oblique view of a preferred embodiment of the ink jet recording apparatus according to the present invention, depicting the general structure.

Hereinafter, the embodiments of the present invention will be described referring to drawings. FIG. 1 is a schematic oblique view of the preferred embodiment of the ink jet recording apparatus according to the present invention, depicting the general structure. In FIG. 1, a recording head 1 and an ink container 2 are integrated to constitute a recording cartridge 3. A carriage 4 carrying this recording cartridge 3 is supported in a manner so as to be movable along guide rails 5 and 6. The carriage 4 is driven so as to shuttle, by a carriage motor 7 through a timing belt 8.

A sheet of recording material 9 made of paper, a thin piece of plastic, or the like is conveyed (fed), through predetermined passages, by a conveyer roller pair 12, which is driven by a conveyer motor (sheet feeding motor) 10, and a holding roller pair 13, which synchronously rotates with the conveyer roller pair 12, with a predetermined timing and with a predetermined pitch, in the direction indicated by an arrow f. The recording material 9 is held flat at a recording position where the recording material faces the ink ejecting portion of the recording head 1, and the carriage 4 is driven to scan the recording head 1 in the main scanning direction, recording thereby an image. After the image equivalent to a single line of recording is completed, the recording material 9 is advanced in the arrow f direction by a distance equivalent to a single pitch, and then, the next line is recorded.

The previously described recording head 1 is an ink jet recording means which uses thermal energy to eject the ink, and is provided with an electrothermal transducer for generating the thermal energy, wherein as the thermal energy generated by the electrothermal transducer is applied to the ink, film boiling occurs to develop and collapse bubbles, changing thereby pressure, and these pressure changes are used to eject the ink from the ejection orifices to record the image.

Figure 2:
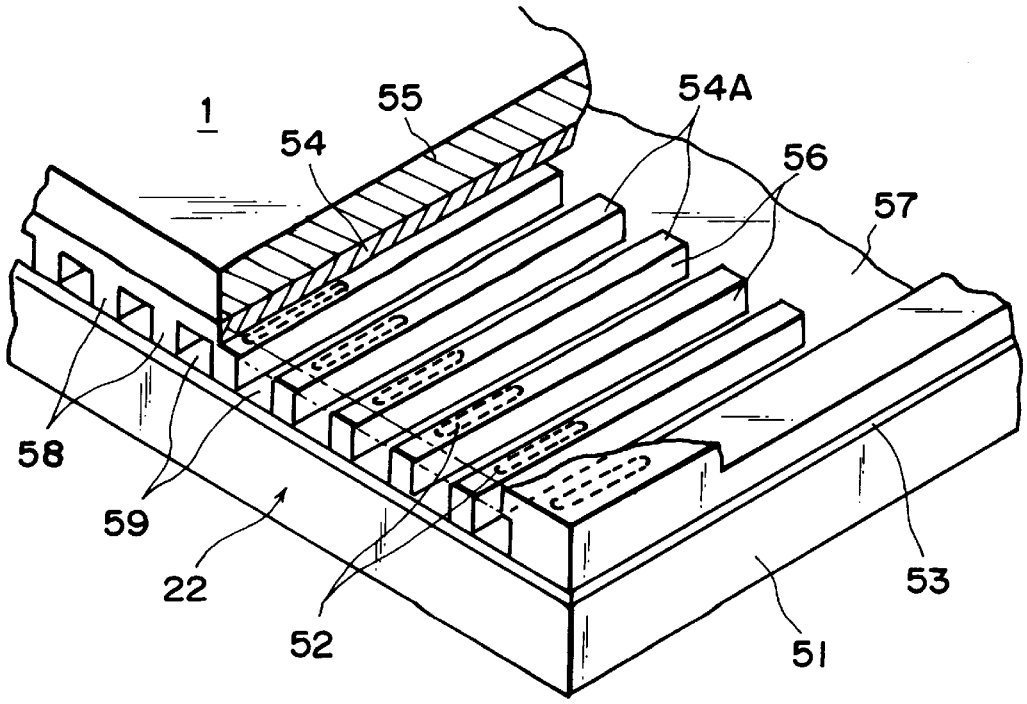
FIG. 2 is a partially cutaway oblique view of a portion of the ink ejecting portion of the recording means illustrated in FIG. 1, depicting schematically the structure.

FIG. 2 is a partial oblique view of the ink ejecting portion of the recording head 1, depicting schematically the structure. In FIG. 2, two or more electrothermal transducers 52, and wiring for serving the electrothermal transducers 52, which are formed through the same manufacturing process (film deposition method or the like) as semiconductors, are located on a substrate 51 of the recording head 1, with a layer of a thin film 53 being interposed. As shown in the drawing, each of the electrothermal transducers 52 is in a liquid passage 56, at a position adjacent to an ejection orifice 52. Attached on the substrate 51 (on the thin film 53 on the substrate 51) is a liquid passage forming member 54, which comprises a number of liquid passage walls 54A formed, in parallel and with predetermined intervals, on the bottom surface of the member 54. Further, a top plate 55 is attached to the upper surface of the liquid passage forming member 54. The liquid passages 56 are formed between each of the liquid passage walls 54A, wherein the liquid passage forming member 54 is attached to the substrate 51 so that each of the electrothermal transducers 52 is positioned in the corresponding liquid passage, at a predetermined position.

Each of the liquid passage walls 54A has a predetermined length, and the rear end of each of the liquid passages 56 communicates with a common liquid chamber 57 formed between the liquid passage forming member 54 and the substrate 51 (that is, thin film 53). On the other hand, the other end (tip) of each liquid passage 56 opens up at the ejection orifice surface of the recording head 1, forming thereby an ejection orifice 59. Now, as power is supplied to the electrothermal transducer 52, such as an exothermic resistor or the like (pulse voltage is applied), it generates heat, whereby the ink within the liquid passage 56 boils in the film-boiling manner, causing pressure changes; therefore, ink droplets are ejected from the ejection orifices 59 of the ink jet recording head 1. The recording head 1 is installed in a manner such that the aligning line of the ejection orifices 59 intersects the direction in which the recording material (sheet of recording paper or the like) is conveyed, wherein the gap between the ejection orifice surface 58 and the recording material 9 is set to be approximately 0.5–2.0 mm.

Referring to FIG. 1, the ink container 2 for supplying the recording head (recording means) 1 with the ink is mounted in an exchangeable manner on the carriage 4, being integrally joined with the recording head 1. A home position HP of the recording head is set up at a predetermined location within the moving range of the carriage 4 as well as outside the recording range. At this home position, a cap 14 is provided, which moves to seal the ink ejecting portion so that the ink within the ejection orifices 56 of the recording head 1 is prevented from drying. This cap 14 is connected to a suction pump (not illustrated). The cap 14 and the suction pump constitute a recovery means (sucking device) 15 of a recovery apparatus for recovering the recording head 1 from ejection failure.

Referring to FIG. 1, a wiping apparatus 16 for cleaning (wiping clean) the ejection orifice surface 58 of the recording head 1 is provided at a position adjacent to the recovery means 15, on the recording range side. The wiping apparatus 16 illustrated in the drawing comprises an endless belt 18 stretched around the upper and lower rollers 17A and 17B, and a number of elastic wiping blades (cleaning members) 19 attached to the belt 18 at a single or multiple locations, wherein the wiping apparatus 16 is movable between a forward position, where the blade or blades 19 come in contact with the ejection orifice surface 58 of the recording head 1, and a retracted position, where the blades 19 do not contact the ejection orifice surface 58. As the endless belt 18 is driven when the wiping apparatus is at the forward position, the ejection orifice surface 58 of the recording head 1 is wiped clean by the cleaning member (blade) 19. This wiping apparatus 16 also constitutes the recovery apparatus for recovering the recording head 1 from ejection failure. The structure of the wiping apparatus 16 comprising the blade or blades 19 is not limited to the one described above, and it may be of a type in which the forward and retracted positions are set up to use the scanning movement of the recording head 1, to wipe clean the ejection orifices surface 58 of the recording head 1.

Figure 3:
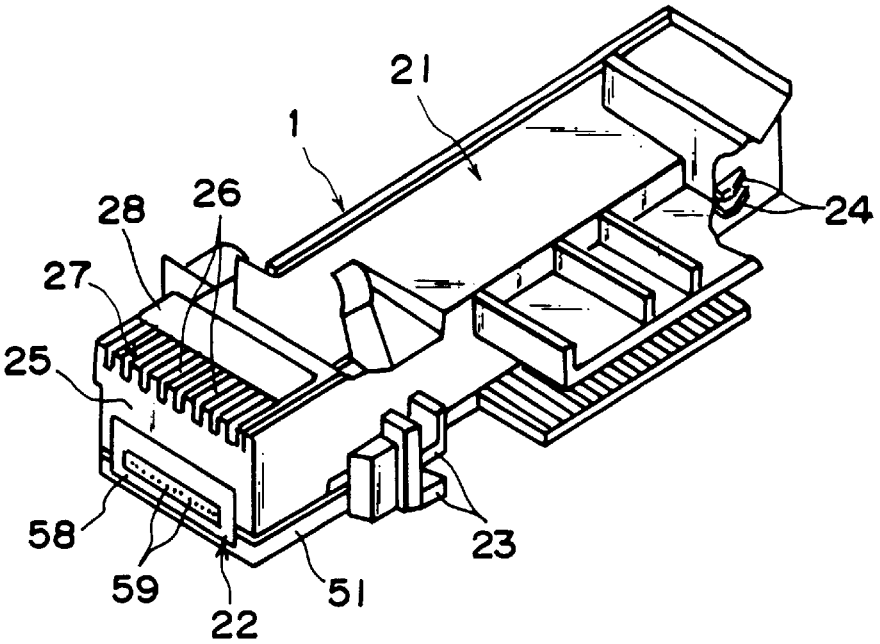
FIG. 3 is a schematic oblique view of the recording means illustrated in FIG. 1, depicting the structure.
Figure 4:
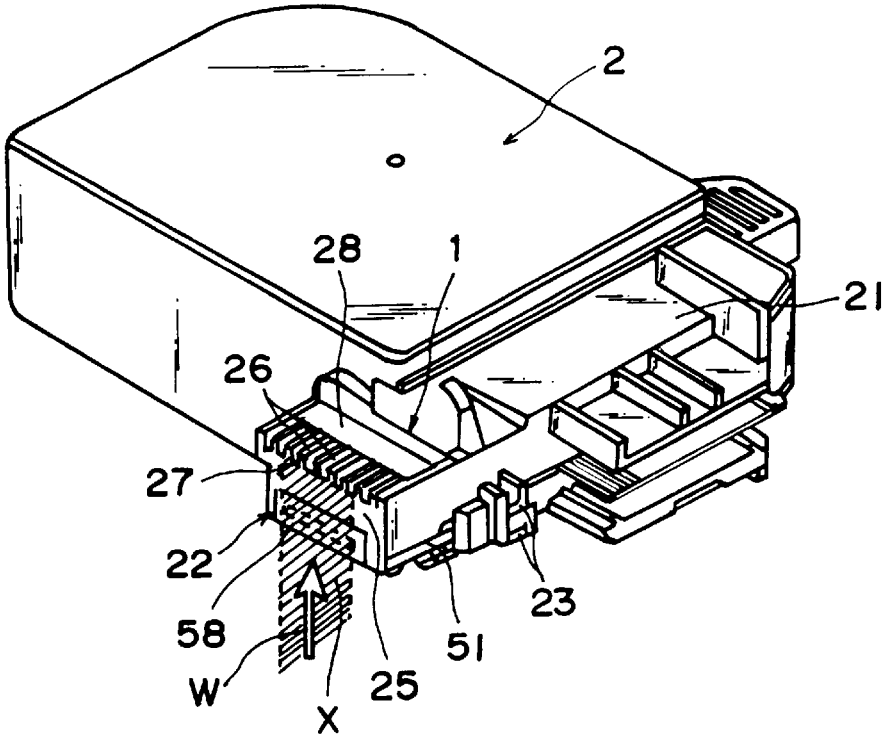
FIG. 4 is a schematic oblique view of the recording cartridge illustrated in FIG. 1, depicting the structure.

FIG. 3 is an oblique view of the first embodiment of the recording head (recording means) according to the present invention. FIG. 4 is an oblique view of a recording cartridge 3 constituted by joining integrally the recording head 1 in FIG. 3 with an ink container 2. Referring to FIGS. 3 and 4, the structure of the recording head 1 is such that an ink ejecting portion 22 is integrally attached to the front portion of a chip container 21, wherein the substrate 51 of the recording head 1 is attached to the chip container 21, on the front portion of the bottom surface. On the front end surface of the ink ejecting portion 22, the ejection orifice surface (orifice plate) 58, on which a number of ejection orifices 59 are horizontally arranged, is attached. Further, on the lateral surface of the recording head 1, joining portions 23 and 24 are formed, with which the ink container 2 and the recording head 1 are joined.

Referring to FIGS. 3 and 4, the front end surface 25 of the chip container 21 is on the same plane as the ejection orifice surface 58, and on the front portion of the upper surface of the chip container 21, a micro-structure 27 comprising a number of ink transferring portions 26, which open at the front end surface 25 of the chip container 21, is formed. In this embodiment, the ink transferring portions 26 are groove-shaped. Further, the multiple grooves (ink transferring portions) 26 are aligned in the same direction as that in which the ejection orifices 59 are aligned on the ejection orifice surface 58. In the chip container 21, an ink absorbing member 28, which is in contact with the rear portion of each of the grooves 26 of the micro-structure 27, is contained. This ink absorbing member 28 is formed of porous material such as sponge or polymer absorbent such as BELL-ETA, which excels in ink absorbency and its ink retaining function.

Referring to FIG. 4, an arrow w indicates the wiping direction (direction in which the blade 19 itself moves, or the apparent moving direction of the blade 19 with reference to the scanning movement of the recording head 1) of the cleaning member (blade) 19, and a solidus area X indicates the wiping area of the cleaning member 19, on the ejection orifice surface and the front end surface 25 of the chip container 21. The cleaning member 19 is selectively placed in contact with the ejection orifice surface 58. After the cleaning member (blade) 19 contacts and wipes the ejection orifice surface 58, it rubs against (contacts) the front end surface 25 of the chip container 21, whereby the contaminants such as the ink or dust adhering to the cleaning member 19 is taken up by the micro-structure 27 (groove 26). Then, the contaminants (ink containing solid foreign matter) taken up within the micro-structure 27 comprising the grooves 26 are delivered by the capillary force of the micro-structure 27 to the opposite surface side, where they are absorbed by the ink absorbing member 28, to be retained therein. Thus, the ink or the like adhering to the surface of the cleaning member 19 is efficiently taken up into the micro-structure 27 side, and then, this ink or the like is forcefully advanced through the grooves 26 by the capillary force, to be absorbed by the absorbing member; therefore, the ink never remains on the micro-structure surface against which the cleaning member 19 is rubbed. As a result, no matter how many times the cleaning operation is repeated, the ink with increased viscosity or the like is prevented from being transferred back. Here, the shape and structure of the ink transferring portion (grooves) 26 play important roles to cause the ink to move swiftly.

Figure 5A:
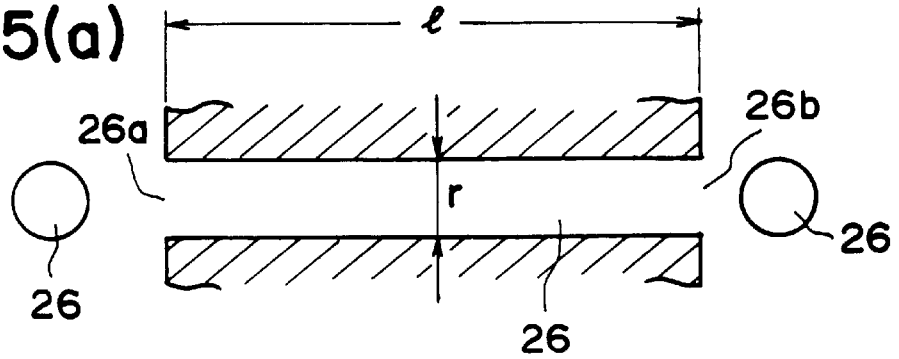
FIGS. 5(*a*)–5(*b*) are explanatory drawings for presenting examples of the shapes and measurements of the embodiment of the micro-structure of the recording means shown in FIG. 1.
Figure 5B:
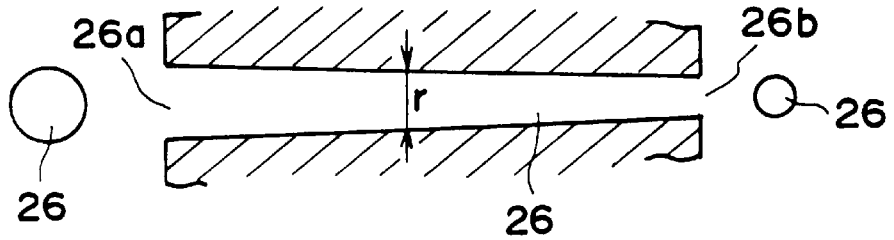
Figure 5C:
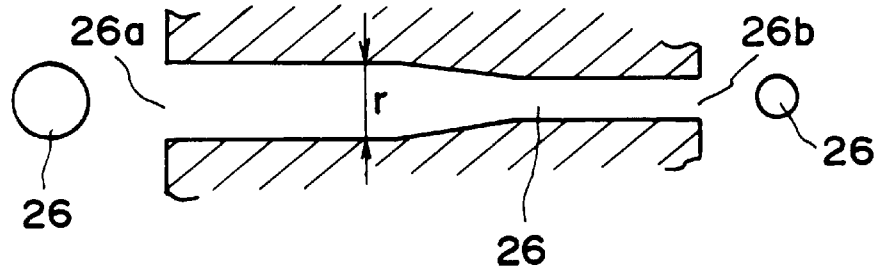

FIGS. 5(*a–c*) and 6(*a–c*) are partially enlarged drawings of the micro-structure 27, depicting the shape of the grooves constituting the ink transferring portion 26.

Referring to FIGS. 6(*a–c*), the cross-section of the groove is square, lacking the upper edge, but this cross-section may be of any shape, for example, a polygon or semi-circle, as long as the groove is formed. Here, a reference letter w designates the groove width; h, the groove depth; and l designates the groove length.

Referring to FIG. (*a*), the structure of the groove is such that the width w and the depth h are the same across the length l from the ink transferring point 26*a* on the side where the cleaning member 19 contacts, to the ink transferring point 26*b* on the side where the absorbing member 28 contacts.

FIG. 6(*b*) shows a groove shape such that the groove width h gradually diminishes from the ink transferring point 26*a* toward the ink transferring portions 26*b*, wherein the groove depth h may be the same at the ink transferring point 26*a* and the ink transferring point 26*b*, but in order to strengthen the capillary force, it is preferred for the groove width to be gradually diminished toward the ink transferring point 26*b*.

Further, FIG. 6(*c*) presents a shape such that the ink transferring groove is partly constricted from the midway toward the ink transferring point 26*b*, that is, a shape for increasing the capillary force.

As is evident from the foregoing, it is preferred for the groove to be shaped so as to display a superior ink conveying performance.

Therefore, the groove shape may be such that the cross-sectional area is the same across the entire length of the groove as shown in FIG. 6(*a*), but it is more preferable for the shape to be such that the groove width gradually diminishes as shown in FIGS. 5(*b*) and 6(*c*), and if the groove depth is also gradually decreased as well as the groove width, the ink delivery performance can be further improved.

The groove shape is not limited to those illustrated above, and various other shapes may be adopted, which are capable of improving the efficiency with which the ink is delivered from the ink transferring portion 26*a* toward the ink transferring point 26*b* by the capillary force.

For example, the groove may be formed as a through-hole as shown in FIGS. 5(*a*), 5(*b*), and 5(*c*), wherein the cross-sectional area of the hole may be the same across its entire length as shown in FIG. 5(*a*), or the structure may be such that the diameter of the through hole is reduced between the ink transferring point 26*a* and the ink transferring point 26*b*.

Further, the cross-sectional shape is not limited to a circle. It may be polygonal.

Next, the dimension of the groove will be discussed.

As long as the groove width w, groove depth h, and groove length l designated in FIGS. 6(*a–c*) satisfy the conditions : w=0.1 . 0.3 mm; h=0.4–0.5 mm; l=3.5–4.5 mm, various dimensional combinations display preferable ink delivery performances. When the width w is narrower than 0.1 mm, an ordinary contaminant such as paper dust, which is wiped off by the cleaning member 19 together with the ink, cannot be smoothly delivered, and so sometimes clogs the groove. Further, when the groove width is more than 0.3 mm (needless to say, the groove depth also influences the outcome), it is liable to create a condition in which the capillary force is not strong enough to deliver satisfactorily the paper dust or other contaminants.

Further, when the groove depth h is shallower than 0.4 mm, the capacity for delivering satisfactorily the paper dust or other contaminants declines, and when it is made deeper than 0.5 mm, not only the ink transferring portion itself has to be enlarged, but also, sufficient capillary force cannot be generated, which is liable to impair the reliability of the ink delivery.

When the groove length l is longer than 4.5 mm, the paper dust or other contaminants suspended in the ink is liable to be deposited within the groove before the ink reaches the absorbing member. When it is shorter than 3.5 mm, there is no substantial problem as far as the ink delivery is concerned, but when it is extremely short, a sufficient capillary force does not develop, whereby as the cleaning member 19 leaves the micro-structure 27, the cleaning blade 19 is trailed by the ink, preventing the ink from being completely taken up; therefore, an approximate length of 3.5 mm is necessary.

Here, the thickness of the wall between the grooves is preferred to be thick enough to afford the strength to withstand the wiping by the cleaning member 19, while being thin enough to prevent the ink from remaining on the wall edge surface when the wall edge surface is wiped by the cleaning member 19. More specifically, it is preferred to be 0.3–0.6 mm.

In the case of the structure in which the cross-sectional area of the groove is gradually reduced as shown in FIGS. 6(*b*) and 6(*c*), the best results can be obtained when the value of the declining rate dw/dl is selected to fall within a range of −4/30—6/80.

In the case of the through hole as shown in FIGS. 5(*a–c*), it is preferred for the radius r to be selected to fall within a range of 0.3–0.5 mm. In the case of the polygonal through hole, the preferable results were obtained when the circle equivalent radius s of the polygonal cross-section was within a range of 0.25–0.5 mm.

In the case of the structure in which the cross-sectional area of the through hole is gradually or partially reduced, the best results were obtained when dr/dl=−0.14—0.06, and when ds/dl=−0.14—0.05.

According to each of the embodiments described in the foregoing, the ejection orifice surface 58 of the recording head 1 and the front end surface 25 of the chip container 21 are placed in the same plane; the micro-structure 27 comprising a number of grooves, circular through holes, or polygonal through holes, which are aligned in the same direction as that in which the ejection orifices 59 of the recording head 1 are aligned, is provided, wherein one end of the micro-structure 27 is made to open up at the front end surface 25 of the chip container, and the other end is placed in contact with ink absorbing member 28; and the wiping blade (cleaning member) 19 is rubbed against the open end portion of the micro-structure 27 after wiping clean the ejection orifices surface 58; whereby the ink suspending the contaminants from the wiping blade 19 is delivered by the capillary force of the micro-structure 27, to the ink absorbing member 28, being thereby absorbed; therefore, the following effects are obtained.

Firstly, it is possible to make the ink absorbing member (porous member) 28 absorb surely the foreign matter or the ink adhering to the cleaning member 19 for wiping clean the ejection orifice surface 58; therefore, the size of the ink absorbing member 28 can be reduced compared to the prior system in which the cleaning member was directly placed in contact with the ink absorbing member, realizing thereby a reduction in the apparatus cost and the apparatus size. Secondly, the solid contaminants or the like can be easily delivered together with the ink by the capillary force of the micro-structure 27; therefore, the probability of the foreign matter removed once by the cleaning member re-adhering to the cleaning member is substantially reduced. Therefore, a phenomenon such that the foreign matter adhering to the cleaning member migrates back to the area adjacent to the ejection orifices 59 can be prevented from occurring, whereby the recording yield can be prevented from being forced to decline by the foreign matter.

Thirdly, the cleaning member rubs against the micro-structure 27 formed integrally with the chip container 21; therefore, it is possible to eliminate problems such as frictional wear of the cleaning member or peeling of the porous member, which occurs when the porous member protrudes excessenely due to variances in the component dimensions. Fourthly, the cleaning member (wiping member) is located away from the ink absorbing member 28; therefore, even when two or more recording heads are wiped during the color recording operations or the like, it is possible to prevent the ink mixing which occurs if the removed ink re-adheres.

Thus, according to the embodiments described in the foregoing, it is possible to reduce the amount of the foreign matter or the ink with increased viscosity, which is drawn out of the ejection orifices 39, or re-enters the ejection orifices 59, while the ejection orifice surface 58 of the recording 1 is wiped; it is possible to prevent the ink from mixing when two or more recording heads are wiped; and it is possible to eliminate the recording deviation or the ink ejection failure, stabilizing thereby the ejection characteristics of the recording head 1, and also, improving the reliability of the recording head 1, whereby the quality of the recorded image can be improved. As a result, an ink jet apparatus is realized that is capable of improving by leaps and bounds the recording yield and the reliability of the recording head 1, while reducing substantially the production cost of the apparatus.

Further, in the case of the embodiments described in the foregoing, a single recording head was employed to record the image. However, the present invention is also applicable to a color ink jet recording apparatus comprising two or more recording heads for recording the image in various colors, an ink jet recording apparatus for recording tone gradation, which comprises two or more recording heads, each of which contains ink of the same color but of different density, or the like ink jet recording apparatus. In other words, the present invention is widely applicable regardless of the number of the recording heads, or recording colors, and the same remarkable effects can be expected. Further, the present invention is applicable to: an ink jet recording apparatus comprising an exchangeable recording cartridge in which the recording head and ink container are integrated; an ink jet recording apparatus comprising separately the recording head and ink container, or the like ink jet recording apparatus. That is, the present invention is applicable in the same manner regardless of the positional relation between the recording head and ink container, and the same remarkable effects can be expected.

Further, in the case of the embodiments described in the foregoing, the description was given with reference to a serial type recording apparatus in which the recording head 1 was mounted on the carriage 4. However, the present invention is applicable in the same manner to a recording apparatus comprising a line type recording head which covers the full width, or a part of the width, of the recording material, and the same effects can be expected.

Hereinbefore, the structure of the micro-struture 27 formed on the chip container constituting a part of the ink jet recording apparatus was described. However, the present invention is not limited by this structure. It is needless to say that the micro-structure may be formed on the lateral plate of the carriage which scans the surface of the recording material while carrying the ink jet head cartridge. Further, in the case of an ink jet recording apparatus such as the color recording apparatus in which a single carriage carries two or more recording heads, the micro-structure 27 comprising the aforementioned through holes may be formed on the carriage, between the heads.

However, in the case of an apparatus in which the micro-structure 27 is provided on the chip container portion of the recording head formed integrally with the ink container, whenever the ink in the ink container is depleted and the ink container is exchanged, the micro-structure is automatically exchanged at the same time; therefore, the functional deterioration of the micro-structure due to extended usage is prevented.

Also, the present invention is applicable to an ink jet cartridge in which the ink container and the recording head are separable. In this case, it is only necessary to properly select the ink absorbing member 28 of the micro-structure 27 in correspondence with the number of the ink containers to be exchanged during the service life of a single recording head. In this case, the recording head is exchanged after a predetermined number of the ink containers are exchanged; therefore, the micro-structure is also automatically replaced.

What is claimed is:

1. An ink jet cartridge comprising:

a plurality of ejection orifices for ejecting an ink;

an ejection orifice surface on which said ejection orifices are located, said ejection orifice surface being disposed for rubbing by a cleaning blade for removing ink and any foreign matter therein from said ejection orifice surface; and an ink removing mechanism including a plurality of elongated grooves without a cover for shielding said grooves, each of said grooves having a cross-section exposed on a surface different from said ejection orifice surface along the length of said grooves and opening on an extension of said ejection orifice surface, wherein said extension is disposed for rubbing by said cleaning blade after said ejection orifice surface is rubbed by said cleaning blade, and an ink absorbing member disposed in contact with said grooves, wherein said grooves are dimensioned for delivering any ink and foreign matter therein adhering to said cleaning blade and entering said openings to said ink absorbing member by capillary force.

2. An ink jet cartridge according to claim 1, wherein the groove has a first cross-sectional area adjacent to said cleaning blade and a second cross-sectional area adjacent to the ink absorbing member, and wherein said first cross-sectional area is larger than said second cross-sectional area.

3. An ink jet cartridge according to claim 1, wherein the groove has a first cross-sectional area adjacent to said cleaning blade and a same cross-sectional area adjacent to the ink absorbing member.

4. An ink jet cartridge according to claim 1, wherein a distance between a cleaning blade contacting an end of the groove and an ink absorbing material contacting end of the groove is 3.5–4.5 mm.

5. An ink jet cartridge according to claim 1, wherein a depth h of the groove is 0.4–0.5 mm.

6. An ink jet cartridge comprising:

a plurality of ejection orifices for ejecting an ink;

an ejection orifice surface on which said ejection orifices are located, said ejection orifice surface being disposed for rubbing by a cleaning blade for removing ink and any foreign matter therein from said ejection orifice surface; and an ink removing mechanism including a plurality of elongated grooves without a cover for shielding said grooves, each of said grooves having a cross-section exposed on a surface different from said ejection orifice surface along the length of said grooves and opening on an extension of said ejection orifice surface, wherein said extension is disposed for rubbing by said cleaning blade after said ejection orifice surface is rubbed by said cleaning blade.

7. An ink jet cartridge according to any of claims 1 or 2–6, further comprising an electrothermal transducer element for generating thermal energy for ejecting the ink through said ejection orifices.

8. An ink jet apparatus comprising:

conveying means for conveying a recording medium;

a recovery mechanism for recovering an ink ejection performance of an ink jet cartridge comprising a recording head for ejecting an ink, said recovery mechanism including a cleaning blade for rubbing said recording head for removing any ink and foreign matter therein from said recording head;

an ink jet carriage which carries said ink jet cartridge, said ink jet carriage for scanning a recording zone where said recording medium is conveyed, and a non-recording zone where said recovery mechanism is located; and an ink removing mechanism disposed on a part of said ink jet cartridge, said ink removing mechanism including a plurality of elongated grooves without a cover for shielding said grooves, each of said grooves having a cross-section exposed on a first surface of said ink jet cartridge along the length of said grooves and opening on a second surface of said ink jet cartridge, wherein said second surface is disposed for rubbing by said cleaning blade after said recording head is rubbed by said cleaning blade, and an ink absorbing member is disposed in contact with said grooves, wherein said grooves are dimensioned for delivering any ink and foreign matter therein adhering to said cleaning blade and entering said openings to said ink absorbing member by capillary force, wherein at least two of said ink jet cartridges are mounted on said carriage so that color recording can be carried out, and said ink removing mechanism is located on said carriage, between said ink jet cartridges.

9. An ink jet apparatus according to claims 8, wherein said ink removing mechanism is located on said carriage, on a lateral surface against which said cleaning blade can be rubbed in a substantially continuous motion after wiping clean said recording head.

10. An ink jet apparatus comprising:

conveying means for conveying a recording medium;

a recovery mechanism for recovering an ink ejection performance of an ink jet cartridge comprising a recording head for ejecting an ink, said recovery mechanism including a cleaning blade for rubbing said recording head for removing any ink and foreign matter therein from said recording head;

an ink jet carriage which carries said ink jet cartridge, said ink jet carriage for scanning a recording zone where said recording medium is conveyed, and a non-recording zone where said recovery mechanism is located; and an ink removing mechanism disposed on a part of said ink jet cartridge, said ink removing mechanism including a plurality of elongated grooves without a cover for shielding said grooves, each of said grooves having a cross-section exposed on a first surface of said ink jet cartridge along the length of said grooves and opening on a second surface of said ink jet cartridge, wherein said second surface is disposed for rubbing by said cleaning blade after said recording head is rubbed by said cleaning blade.

11. An ink jet apparatus according to any of claims 8, 9 or 10, wherein said recording head includes ejection orifices for ejecting the ink, and further comprising an electrothermal transducer element for generating thermal energy for ejecting the ink through said ejection orifices.

* * * * *

UNITED STATES PATENT AND TRADEMARK OFFICE

CERTIFICATE OF CORRECTION

PATENT NO. : 5,988,792

DATED : November 23, 1999

INVENTOR(S) : Okazaki et al.

It is certified that error appears in the above-identified patent and that said Letters Patent is hereby corrected as shown below:

COLUMN 3

Line 60, "5(a)-5(b)" should read --5(a)-5(c)--; and
Line 64, "6(a)-6(b)" should read --6(a)-6(c)--.

COLUMN 6

Figures 6A, 6B, 6C:
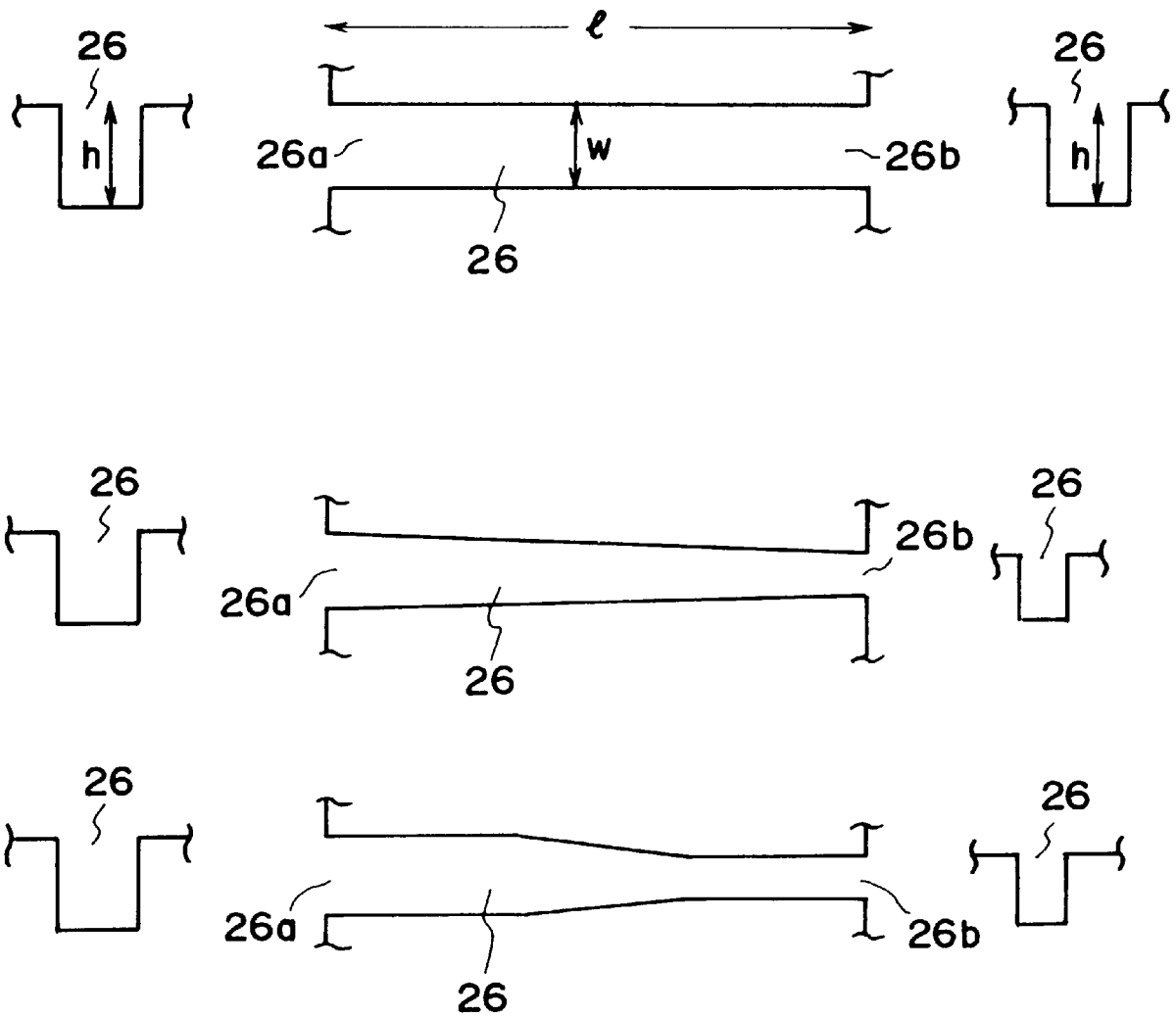
FIGS. 6(*a*)–6(*b*) are explanatory drawings for presenting examples of the shapes and measurements of an alternative embodiment of the micro-structure of the recording means shown in FIG. 1.

Line 56, "FIG. (a)," should read --FIG. 6(a),--.

COLUMN 8

Line 63, "excessenely" should read --excessively--.

COLUMN 11

Line 35, "carriage," should read --carriage--.

Signed and Sealed this

Second Day of January, 2001

*Attest:*

*Attesting Officer*

Q. TODD DICKINSON

*Commissioner of Patents and Trademarks*